US012258657B2

(12) United States Patent
Seong et al.

(10) Patent No.: US 12,258,657 B2
(45) **Date of Patent: *Mar. 25, 2025**

(54) HOT-ROLLED STEEL SHEET HAVING EXCELLENT IMPACT RESISTANCE, STEEL PIPE, MEMBER, AND MANUFACTURING METHODS THEREFOR

(71) Applicant: POSCO, Pohang-si (KR)

(72) Inventors: Hwan-Goo Seong, Gwangyang-si (KR); Yeol-Rae Cho, Gwangyang-si (KR); Seong-Beom Bae, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/752,306

(22) Filed: May 24, 2022

(65) Prior Publication Data

US 2022/0341012 A1 Oct. 27, 2022

Related U.S. Application Data

(62) Division of application No. 16/957,948, filed as application No. PCT/KR2018/015900 on Dec. 14, 2018, now abandoned.

(30) Foreign Application Priority Data

Dec. 26, 2017 (KR) ..... 10-2017-0180183

(51) Int. Cl.
*C22C 38/02* (2006.01)
*C21D 6/00* (2006.01)
(Continued)

(52) U.S. Cl.
CPC ..... *C22C 38/54* (2013.01); *C21D 6/004* (2013.01); *C21D 6/005* (2013.01); *C21D 6/008* (2013.01);
(Continued)

(58) Field of Classification Search
CPC ..... C21D 2211/005; C21D 2211/009; C21D 8/02; C21D 8/0226; C21D 8/105; C21D 9/46; C22C 38/00
(Continued)

(56) References Cited

U.S. PATENT DOCUMENTS 6,083,455 A 7/2000 Kurita et al.
10,253,388 B2 * 4/2019 Cho ..... C22C 38/32
(Continued)

FOREIGN PATENT DOCUMENTS

CN 1840723 A 10/2006
CN 104745942 A 7/2015
(Continued)

OTHER PUBLICATIONS

International Search Report dated Mar. 15, 2019 issued in International Patent Application No. PCT/KR2018/015900 (along with English translation).
(Continued)

*Primary Examiner* — Jie Yang
(74) *Attorney, Agent, or Firm* — Morgan, Lewis & Bockius LLP

(57) ABSTRACT

A preferable aspect of the present invention provides: a hot-rolled steel sheet with excellent impact resistance containing, by weight, 0.35-0.55% of C, 0.7-1.5% of Mn, 0.3% or less (excluding 0%) of Si, 0.03% or less (including 0%) of P, 0.004% or less (including 0%) of S, 0.04% or less (excluding 0%) of Al, 0.3% or less (excluding 0%) of Cr, 0.3% or less (excluding 0%) of Mo, one or two of 0.1-1.0% of Ni and 0.1-1.0% of Cu, 0.4% or more of Cu+Ni, 0.006% or less (excluding 0%) of N, and the balance Fe and other impurities, the alloy elements satisfying relational formulas 1 to 3 below, wherein a microstructure of the hot-rolled steel sheet comprises, by volume, 10% or more of ferrite and 90%
(Continued)

or less of pearlite; a steel pipe and a member each using the same; and manufacturing methods therefore.

$(Mn/Si) \geq 3$ (weight ratio) [Relational formula 1]

$(Ni+Cu)/(C+Mn) \geq 0.2$ (weight ratio) [Relational formula 2]

$(Ni/Si) \geq$ (weight ratio). [Relational formula 3]

9 Claims, 4 Drawing Sheets

(51) Int. Cl.

| | |
|---|---|
| ***C21D 8/02*** | (2006.01) |
| ***C21D 8/10*** | (2006.01) |
| ***C21D 9/08*** | (2006.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/50*** | (2006.01) |
| ***C22C 38/54*** | (2006.01) |

(52) U.S. Cl.
CPC ..... *C21D 8/0205* (2013.01); *C21D 8/0226* (2013.01); *C21D 8/0257* (2013.01); *C21D 8/105* (2013.01); *C21D 9/08* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/50* (2013.01); *C21D 2211/005* (2013.01); *C21D 2211/009* (2013.01)

(58) Field of Classification Search
USPC ..... 420/91
See application file for complete search history.

(56) References Cited

U.S. PATENT DOCUMENTS

| | | | | |
|---|---|---|---|---|
| 10,584,396 | B2 * | 3/2020 | Cho | C22C 38/04 |
| 2008/0247900 | A1 | 10/2008 | Hayashi et al. | |
| 2013/0284324 | A1 | 10/2013 | Koh et al. | |
| 2015/0368768 | A1 | 12/2015 | Aratani | |
| 2016/0304981 | A1 | 10/2016 | Song et al. | |
| 2016/0312331 | A1 * | 10/2016 | Cho | C22C 38/001 |
| 2018/0002775 | A1 | 1/2018 | Cho et al. | |
| 2018/0298475 | A1 | 10/2018 | Ishitsuka et al. | |
| 2019/0003004 | A1 * | 1/2019 | Cho | C21D 8/0405 |
| 2020/0362429 | A1 | 11/2020 | Seong | |

FOREIGN PATENT DOCUMENTS

| | | | |
|---|---|---|---|
| CN | 106480355 | A | 3/2017 |
| CN | 107109509 | A | 8/2017 |
| EP | 3239339 | A1 | 11/2017 |
| JP | S62-89813 | A | 4/1987 |
| JP | H11-80899 | A | 3/1999 |
| JP | 2000-319730 | A | 11/2000 |
| JP | 2005-205477 | A | 8/2005 |
| JP | 2006-037205 | A | 2/2006 |
| JP | 4449795 | B2 | 2/2010 |
| JP | 4684003 | B2 | 2/2011 |
| JP | 2011-099149 | A | 5/2011 |
| JP | 2011-236483 | A | 11/2011 |
| KR | 10-2006-0076741 | A | 7/2006 |
| KR | 10-2007-0068665 | A | 7/2007 |
| KR | 10-2009-0124263 | A | 12/2009 |
| KR | 10-1568549 | B1 | 11/2015 |
| KR | 10-2016-0053102 | A | 5/2016 |
| KR | 10-2016-0053790 | A | 5/2016 |
| KR | 10-2016-0078850 | A | 7/2016 |
| KR | 10-2016-0082602 | A | 7/2016 |
| KR | 10-2016-0086877 | A | 7/2016 |
| WO | 2016/105089 | A1 | 6/2016 |
| WO | 2017/110254 | A1 | 6/2017 |
| WO | 2017/111456 | A1 | 6/2017 |

OTHER PUBLICATIONS

U.S. Non-Final Office Action dated Feb. 25, 2022 issued in U.S. Appl. No. 16/957,948.
U.S. Office Action dated Nov. 7, 2021 issued in U.S. Appl. No. 16/957,948.
Partial European Search Report dated Nov. 30, 2020 issued in European Patent Application No. 18895729.4.
Office Action issued in corresponding Chinese Patent Application No. 201880084178.5 dated Apr. 6, 2021.
Lan Liu, et al., High-Performance Steels, World Bridges, No. 1, Jan. 31, 1997, pp. 50-58.
Chengning Li, et al., "Production situation and development trend of the hot-rolled dual phase steel for automobile structure," Steel Rolling, Oct. 2021, vol. 29, No. 5, pp. 38-42.
F. A. Khalid, et al., "Strengthening of hot-rolled high-carbon steels by copper additions and controlled cooling," Scripta Metallurgica et Materialia, vol. 30, No. 7, 1994, pp. 869-873.
J. Richter, et al., "Influence of Mn and Si contents on structure and mechanical properties of ferritic-pearlitic HSLA steels," Materials technology, steel research 64 (1993) No. 5, pp. 267-274.
Japanese Office Action dated Aug. 31, 2021 issued in Japanese Patent Application No. 2020-535245.

* cited by examiner

[Fig. 1]
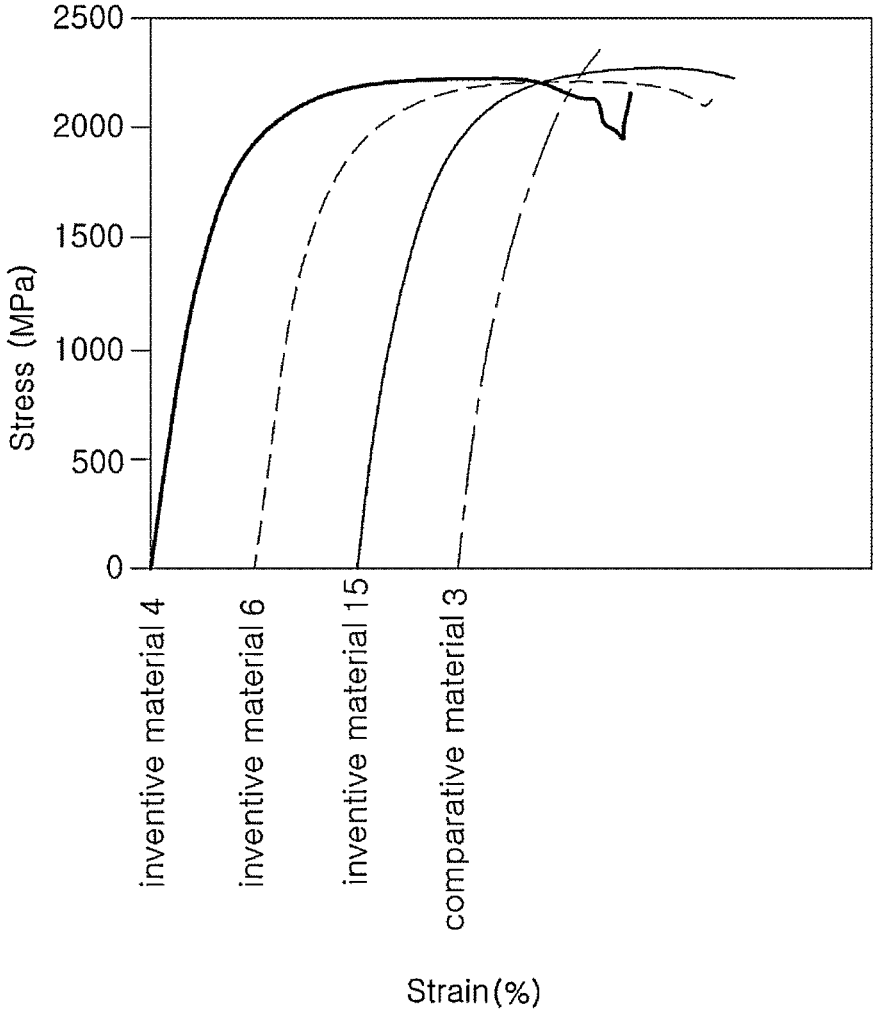

[Fig. 2]
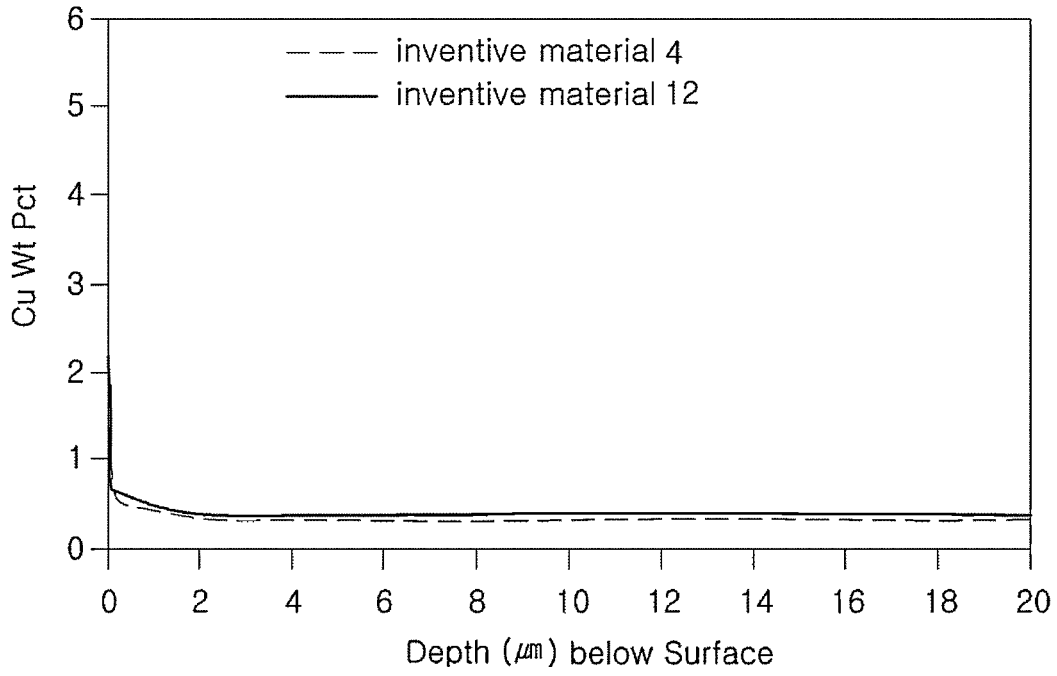

[Fig. 3]
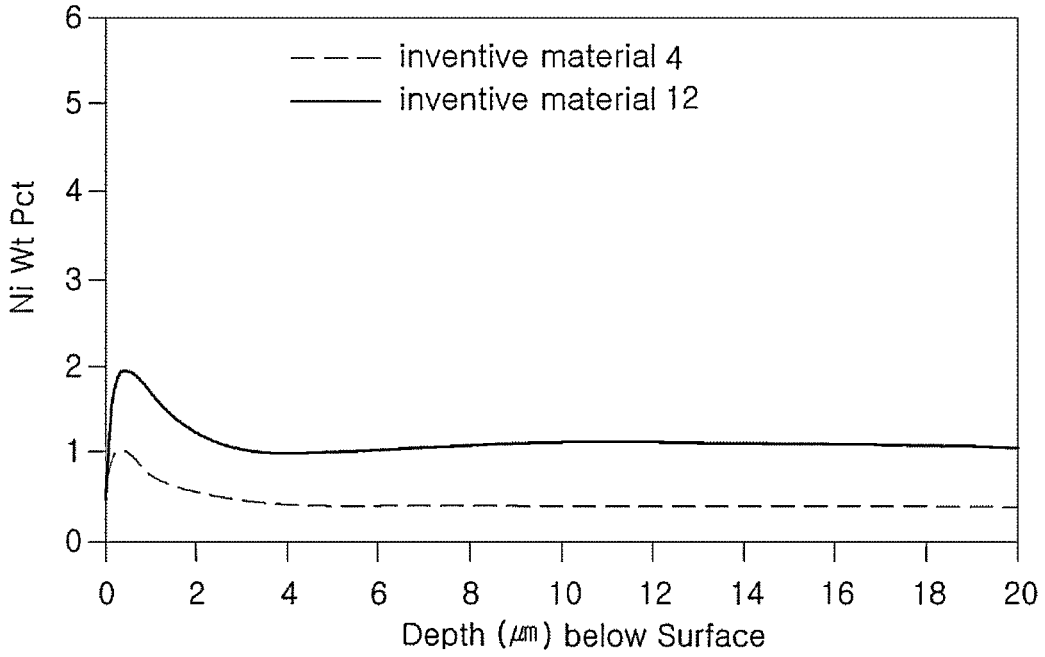

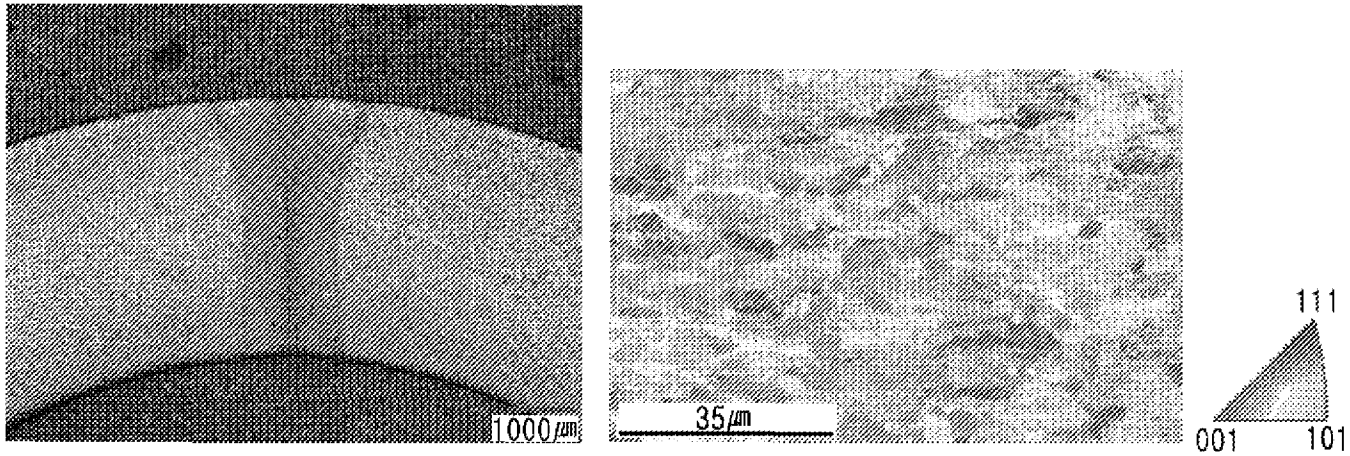
[FIG.4(a)]
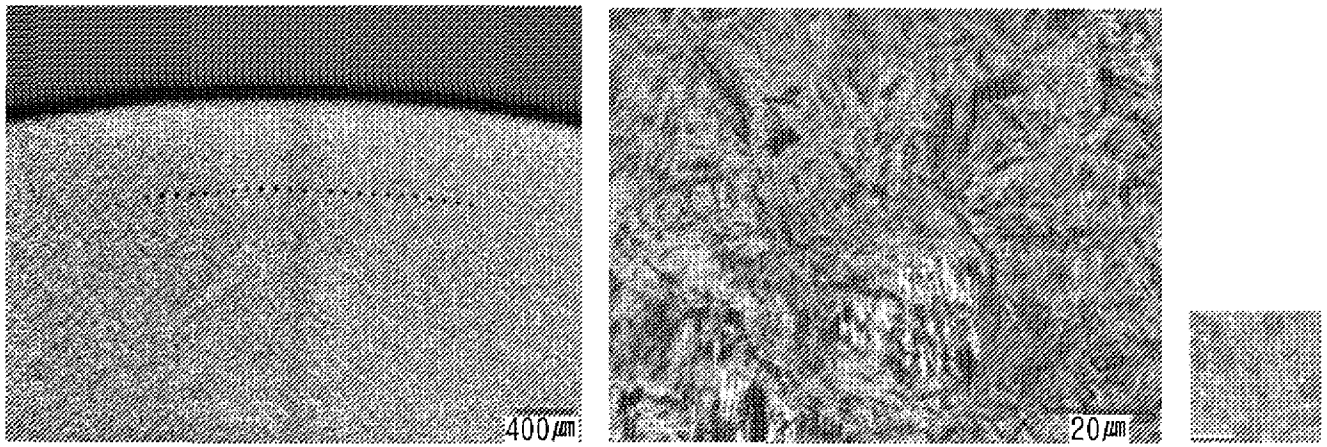
[FIG.4(b)]

HOT-ROLLED STEEL SHEET HAVING EXCELLENT IMPACT RESISTANCE, STEEL PIPE, MEMBER, AND MANUFACTURING METHODS THEREFOR

CROSS-REFERENCE OF RELATED APPLICATIONS

This application is a Divisional Patent Application of U.S. patent application Ser. No. 16/957,948, filed on Jun. 25, 2020, which is the U.S. National Phase under 35 U.S.C. § 371 of International Patent Application No. PCT/KR2018/015900, filed on Dec. 14, 2018, which in turn claims the benefit of Korean Patent Application No. 10-2017-0180183, filed on Dec. 26, 2017, the entire disclosures of which applications are incorporated by reference herein.

TECHNICAL FIELD

The present disclosure relates to a hot-rolled steel sheet used for a vehicle body component, or the like, such as a suspension component of a vehicle, and the like, a steel pipe and a member using the same, and a manufacturing method therefor, and more particularly, a hot-rolled steel sheet having excellent impact resistance and rust resistance and exhibiting ultra-high strength after a heat treatment, a steel pipe and a member using the same, and a manufacturing method therefor.

BACKGROUND ART

A suspension component among vehicle body components is a component requiring high strength-high toughness, corrosion resistance, fatigue durability, and the like, and a hot-rolled steel sheet is mainly applied thereto.

Such a suspension component may be manufactured by hot-rolling forming or cold-rolling forming and performing a heat treatment on a pipe-shaped component. It has been known that, in most cases, pre-fracture may occur in a process of manufacturing the component or in a component use environment. It has been known that the fracture may occur for various reasons, and basically, it has been assumed that the fracture may be caused by quench cracking occurring in the process of manufacturing a steel pipe using a manufactured steel sheet or by hydrogen delayed fracture due to hydrogen atoms and/or molecules mixed into a steel pipe in the manufacturing process or a use environment. Hydrogen delayed fracture may include technical terms such as hydrogen embrittlement, hydrogen delayed cracking, and hydrogen induced cracking, and the like. It has been found that the effect of hydrogen delayed fracture may be significant in an ultra-high strength steel sheet or steel pipe having 1800 MPa or higher of tensile strength after a heat treatment.

Meanwhile, as a method for increasing fatigue resistance of a steel pipe component, in an aspect of preventing pre-breakage or pre-fracture of a steel pipe component, various research has been conducted to find a reason for hydrogen delayed fracture or hydrogen induced cracking and to derive a method for resolving the issue.

Reference 1 discloses that Nb element may be added to steel used for a cold-rolled steel sheet in a large amount, in less than 0.1%, an annealing heat treatment may be performed to a steel sheet obtained by cold-rolling steel while controlling a prior austenite grain size (PAGS) of the steel sheet to be less than 20 μm, preferably to be less than 15 μm, and in a quenched cold-rolled steel sheet or a quenched-tempered cold-rolled steel sheet, delayed fracture of at least about 24 hr may be prevented even under the conditions in which U-shape bending and HCl (pH=1) submerging are performed.

It is disclosed that, similarly to reference 2, resistance to delayed fracture may improve by an effect in which hydrogen in steel may be caught in a refined grain boundary by Nb or Ti precipitate such that threshold hydrogen amount causing delayed fracture may be dispersed.

Reference 1 indicates that, as it has been confirmed that Ni element in steel including a high amount of Si, 0.5% or higher, may deteriorate resistance to delayed fracture, less than 0.5% of Ni element may be added, and it may be preferable to control Ni to be an impurities level, a 0.03% level, as possible. That is a result of an experiment using a steel sheet sample quenched (underwater cooled) at a rapid cooling rate of 100° C./sec or higher, which is U-bent or submerged in HCI acid, or a steel sheet sample to which a quenching-tempering heat treatment is performed, and it is deemed that the reason why the delayed fracture properties is deteriorated is that cracks remain in the quenched steel sheet having a martensite phase structure, or hydrogen which has already been flowed into or to be flowed into steel and into a plurality of defect sites including dislocations formed by underwater rapid cooling may be dispersed and may form a stress concentrated portion such that hydrogen delayed fracture of steel may be facilitated in a form which may decrease threshold stress required for initiation or propagation of cracks.

Also, to improve resistance to delayed fracture of steel, a method of preventing local corrosion (pitting) of steel, reducing permeation of hydrogen atoms into steel, or collecting permeated hydrogen atoms to prevent the hydrogen atoms from exceeding a threshold content by forming various defect sites including dislocation/a grain boundary/a precipitate interfacial surface in steel has been suggested. Particularly, reference 2 suggests that, by controlling a shape of retained austenite to control an axis ratio (a long axis/a short axis) of retained austenite to be 5 or greater on a microstructure forming phase including bainitic ferrite+martensite+retained austenite, formed in cold-rolling forming, using a cold-rolled steel sheet manufactured from steel including a high content of Si, a 1-3% level, which has undergone a heating-cooling-tempering process through a continuous annealing process, hydrogen embrittlement properties may improve since wall boundary fracture is prevented in a process of observing a fractured surface after a tensile test of a steel component. Meanwhile, the above-described steel sheet is a steel sheet having properties of tensile strength after a heat treatment of less than 1500 Mpa, and it may be assumed that sensitivity for hydrogen embrittlement may be relatively lower than that of a martensite or tempered martensite single phase structure steel. Meanwhile, delayed fracture properties of a martensite single phase structure has been suggested as a method for improving fatigue lifespan of a wire rod component, and reference 3 suggests a method of preventing permeation of hydrogen into a component by controlling a B/Cr content ratio to be less than 0.04 in steel containing a high content of Si+Cr to form a boron (B) thickened layer on a surface layer of a steel component.

A temperature suggested for a tempering heat treatment for manufacturing a wire rod bolt component is a range of 350-550° C., which is a relatively high temperature tempering heat treatment, and it is likely that the amount of hydrogen which may remain in steel may be discharged externally in the process of the high temperature tempering heat treatment process, and it is assumed that heat treatment strength of the component according to the high temperature heat treatment may be relatively low such that sensitivity of hydrogen embrittlement may not be high. The cited reference, however, only suggests fracture strength of the component after a heat treatment, not final strength.

Reviewing the processes of manufacturing a steel sheet and a steel component suggested in the cited references, the cited references do not suggest a hot-rolled steel sheet having excellent impact resistance and rust resistance, in relation to which impact resistance and tensile strength of a steel sheet or a component in heating-rapid cooling or heating-rapid cooling-tempering heat treatment may be 1800 MPa or higher, and no pre-tensile breakage or pre-fracture of quenched steel occurs, a steel pipe, and a manufacturing method therefor.

(Reference 1) Korean Laid-Open Patent Publication No. 10-2016-0086877

(Reference 2) Korean Laid-Open Patent Publication No. 10-2006-0076741

(Reference 3) Korean Laid-Open Patent Publication No. 10-2007-0068665

DISCLOSURE

Technical Problem

A preferable aspect of the present disclosure is to provide a hot-rolled steel sheet which has excellent impact resistance and rust resistance and exhibits ultra-high strength after a heat treatment, in which pre-breakage and abnormal fracturing does not occur in a tensile test even with a relatively short natural aging time.

Another preferable aspect of the present disclosure is to provide a method of manufacturing a hot-rolled steel sheet which has excellent impact resistance and rust resistance and exhibits ultra-high strength after a heat treatment, in which pre-breakage and abnormal fracturing does not occur in a tensile test even for a relatively short natural aging time.

Another preferable aspect of the present disclosure is to provide a steel pipe manufactured using a hot-rolled steel sheet which has excellent impact resistance and rust resistance and exhibits ultra-high strength after a heat treatment, in which pre-breakage and abnormal fracturing does not occur in a tensile test even for a relatively short natural aging time.

Another preferable aspect of the present disclosure is to provide a method of manufacturing a steel pipe using a hot-rolled steel sheet which has excellent impact resistance and rust resistance and exhibits ultra-high strength after a heat treatment, in which pre-breakage and abnormal fracturing does not occur in a tensile test even for a relatively short natural aging time.

Another preferable aspect of the present disclosure is to provide a member using a steel pipe manufactured using a hot-rolled steel sheet which has excellent impact resistance and rust resistance and exhibits ultra-high strength after a heat treatment, in which pre-breakage and abnormal fracturing does not occur in a tensile test, even for a relatively short natural aging time.

Another preferable aspect of the present disclosure is to provide a method of manufacturing a member using a steel pipe manufactured using a hot-rolled steel sheet which has excellent impact resistance and rust resistance and exhibits ultra-high strength after a heat treatment, in which pre-breakage and abnormal fracturing does not occur in a tensile test even for a relatively short natural aging time.

Technical Solution

A preferable aspect of the present disclosure provides a hot-rolled steel sheet having excellent impact resistance including, by weight %, 0.35-0.55% of C, 0.7-1.5% of Mn, 0.3% or less (excluding 0%) of Si, 0.03% or less (including 0%) of P, 0.004% or less (including 0%) of S, 0.04% or less (excluding 0%) of Al, 0.3% or less (excluding 0%) of Cr, 0.3% or less (excluding 0%) of Mo, one or two of 0.1-1.0% of Ni and 0.1-1.0% of Cu, 0.4% or more of Cu+Ni, 0.006% or less (excluding 0%) of N, and a balance of Fe and other impurities, the alloy elements satisfying relational formulae 1-3 as below, where a microstructure includes, by volume %, 10-30% of ferrite and 70-90% of pearlite.

$(Mn/Si) \geq 3$ (a weight ratio) [Relational Formula 1]

$(Ni+Cu)/(C+Mn) \geq 0.2$ (a weight ratio) [Relational Formula 2]

$(Ni/Si) \geq 1$ (a weight ratio) [Relational Formula 3]

Another preferable aspect of the present disclosure provides a method of manufacturing a hot-rolled steel sheet having excellent impact resistance, the method including heating a steel slab including, by weight %, 0.35-0.55% of C, 0.7-1.5% of Mn, 0.3% or less (excluding 0%) of Si, 0.03% or less (including 0%) of P, 0.004% or less (including 0%) of S, 0.04% or less (excluding 0%) of Al, 0.3% or less (excluding 0%) of Cr, 0.3% or less (excluding 0%) of Mo, one or two of 0.1-1.0% of Ni and 0.1-1.0% of Cu, 0.4% or more of Cu+Ni, 0.006% or less (excluding 0%) of N, and a balance of Fe and other impurities, the alloy elements satisfying relational formulae 1-3 as below, within a temperature range of 1150-1300° C.;

$(Mn/Si) \geq 3$ (a weight ratio) [Relational Formula 1]

$(Ni+Cu)/(C+Mn) \geq 0.2$ (a weight ratio) [Relational Formula 2]

$(Ni/Si) \geq 1$ (a weight ratio) [Relational Formula 3]

obtaining a hot-rolled steel sheet by hot-rolling, including rough-rolling and finishing-rolling, the heated slab at a temperature of Ar3 or higher; and cooling the hot-rolled steel sheet on a run-out table and coiling the hot-rolled steel sheet at a temperature of 550-750° C.

The method of manufacturing a hot-rolled steel sheet having excellent impact resistance may further include obtaining a hot-rolled pickled steel sheet by pickling the hot-rolled steel sheet.

Another preferable aspect of the present disclosure provides a steel pipe including by weight %, 0.35-0.55% of C, 0.7-1.5% of Mn, 0.3% or less (excluding 0%) of Si, 0.03% or less (including 0%) of P, 0.004% or less (including 0%) of S, 0.04% or less (excluding 0%) of Al, 0.3% or less (excluding 0%) of Cr, 0.3% or less (excluding 0%) of Mo, one or two of 0.1-1.0% of Ni and 0.1-1.0% of Cu, 0.4% or more of Cu+Ni, 0.006% or less (excluding 0%) of N, and a balance of Fe and other impurities, the alloy elements satisfying relational formulae 1-3 as below, where a microstructure includes, by volume %, 10-60% of ferrite and 40-90% of pearlite.

$(Mn/Si) \geq 3$ (a weight ratio) [Relational Formula 1]

$(Ni+Cu)/(C+Mn) \geq 0.2$ (a weight ratio) [Relational Formula 2]

$(Ni/Si) \geq 1$ (a weight ratio) [Relational Formula 3]

Another preferable aspect of the present disclosure provides a method of manufacturing a steel pipe, the method including heating a steel slab including, by weight %, 0.35-0.55% of C, 0.7-1.5% of Mn, 0.3% or less (excluding 0%) of Si, 0.03% or less (including 0%) of P, 0.004% or less (including 0%) of S, 0.04% or less (excluding 0%) of Al, 0.3% or less (excluding 0%) of Cr, 0.3% or less (excluding 0%) of Mo, one or two of 0.1-1.0% of Ni and 0.1-1.0% of Cu, 0.4% or more of Cu+Ni, 0.006% or less (excluding 0%) of N, and a balance of Fe and other impurities, the alloy elements satisfying relational formulae 1-3 as below, within a temperature range of 1150-1300° C.;

$(Mn/Si) \geq 3$ (a weight ratio) [Relational Formula 1]

$(Ni+Cu)/(C+Mn) \geq 0.2$ (a weight ratio) [Relational Formula 2]

$(Ni/Si) \geq 1$ (a weight ratio) [Relational Formula 3]

obtaining a hot-rolled steel sheet by hot-rolling, including rough-rolling and finishing-rolling, the heated slab at a temperature of Ar3 or higher;

cooling the hot-rolled steel sheet on a run-out table and coiling the hot-rolled steel sheet at a temperature of 550-750° C.;

obtaining a steel pipe by welding the hot-rolled steel sheet; and performing an annealing heat treatment on the steel pipe.

The method of manufacturing a steel pipe may further include performing a drawing process after the annealing heat treatment.

Another preferable aspect of the present disclosure provides a member including, by weight %, 0.35-0.55% of C, 0.7-1.5% of Mn, 0.3% or less (excluding 0%) of Si, 0.03% or less (including 0%) of P, 0.004% or less (including 0%) of S, 0.04% or less (excluding 0%) of Al, 0.3% or less (excluding 0%) of Cr, 0.3% or less (excluding 0%) of Mo, one or two of 0.1-1.0% of Ni and 0.1-1.0% of Cu, 0.4% or more of Cu+Ni, 0.006% or less (excluding 0%) of N, and a balance of Fe and other impurities, the alloy elements satisfying relational formulae 1-3 as below, where a microstructure includes one or two of 90% or more of martensite and tempered martensite, and 10% or less of retained austenite.

$(Mn/Si) \geq 3$ (a weight ratio) [Relational Formula 1]

$(Ni+Cu)/(C+Mn) \geq 0.2$ (a weight ratio) [Relational Formula 2]

$(Ni/Si) \geq 1$ (a weight ratio) [Relational Formula 3]

Another preferable aspect of the present disclosure provides a method of manufacturing a member, the method including heating a steel slab including, by weight %, 0.35-0.55% of C, 0.7-1.5% of Mn, 0.3% or less (excluding 0%) of Si, 0.03% or less (including 0%) of P, 0.004% or less (including 0%) of S, 0.04% or less (excluding 0%) of Al, 0.3% or less (excluding 0%) of Cr, 0.3% or less (excluding 0%) of Mo, one or two of 0.1-1.0% of Ni and 0.1-1.0% of Cu, 0.4% or more of Cu+Ni, 0.006% or less (excluding 0%) of N, and a balance of Fe and other impurities, the alloy elements satisfying relational formulae 1-3 as below, within a temperature range of 1150-1300° C.;

$(Mn/Si) \geq 3$ (a weight ratio) [Relational Formula 1]

$(Ni+Cu)/(C+Mn) \geq 0.2$ (a weight ratio) [Relational Formula 2]

$(Ni/Si) \geq 1$ (a weight ratio) [Relational Formula 3]

obtaining a hot-rolled steel sheet by hot-rolling, including rough-rolling and finishing-rolling, the heated slab at a temperature of Ar3 or higher;

cooling the hot-rolled steel sheet on a run-out table and coiling the hot-rolled steel sheet at a temperature of 550-750° C.;

obtaining a steel pipe by welding the hot-rolled steel sheet;

performing an annealing heat treatment on the steel pipe and drawing the steel pipe;

obtaining the member by hot-rolling the drawn steel pipe; and quenching, or quenching and tempering the member.

Advantageous Effects

According to a preferable aspect of the present disclosure, a hot-rolled steel sheet and a steel pipe which have excellent impact resistance and rust resistance in which pre-fracture does not occur in a tensile test may be provided, and there may be an effect in which hydrogen embrittlement which may occur in a process of manufacturing a steel pipe or an in-service process of a steel pipe component may be reduced.

DESCRIPTION OF DRAWINGS

FIG. 1 is tensile curves showing a form of fracture of inventive materials 4, 6, and 15 and comparative material 3 of the present embodiment;

FIG. 2 shows distribution of a copper (Cu) element present in a surface layer of a hot-rolled steel sheet of inventive materials 4 and 12 of the present embodiment;

FIG. 3 shows distribution of a nickel (Ni) element present in a surface layer of a hot-rolled steel sheet of inventive materials 4 and 12 of the present embodiment; and FIGS. 4(*a*) and 4(*b*) show optical microstructures before and after a heat treatment of a drawing pipe of inventive material 4 of the present embodiment, and (*a*) shows a microstructure of a drawn pipe before a heat treatment, and (*b*) shows a microstructure of a drawn pipe after a heat treatment.

BEST MODE FOR INVENTION

Hereinafter, the present disclosure will be described.

Firstly, a hot-rolled steel sheet having excellent impact resistance according to a preferable aspect of the present disclosure will be described.

The hot-rolled steel sheet having excellent impact resistance according to a preferable aspect of the present disclosure may include, by weight %, 0.35-0.55% of C, 0.7-1.5% of Mn, 0.3% or less (excluding 0%) of Si, 0.03% or less (including 0%) of P, 0.004% or less (including 0%) of S, 0.04% or less (excluding 0%) of Al, 0.3% or less (excluding 0%) of Cr, 0.3% or less (excluding 0%) of Mo, one or two of 0.1-1.0% of Ni and 0.1-1.0% of Cu, 0.4% or more of Cu+Ni, 0.006% or less (excluding 0%) of N, and a balance of Fe and other impurities, the alloy elements satisfying relational formulae 1-3 as below:

$(Mn/Si) \geq 3$ (a weight ratio) [Relational Formula 1]

$(Ni+Cu)/(C+Mn) \geq 0.2$ (a weight ratio) [Relational Formula 2]

$(Ni/Si) \geq 1$ (a weight ratio) [Relational Formula 3]

C: 0.35-0.55 Weight % (Hereinafter, Referred to as "%")

Carbon (C) may be effective for increasing strength of steel, and may increase strength after a quenching heat treatment. When a content thereof is less than 0.35%, it may be difficult to secure sufficient strength of 1800 Mpa or higher after a tempering heat treatment, whereas, when the content exceeds 0.55%, martensite having excessive hardness may be formed such that cracks may be created in a steel sheet material or a steel pipe component, which may deteriorate fatigue durability. Thus, it may be preferable to limit a content of carbon (C) to 0.35-0.55%.

Mn: 0.7-1.5%

Manganese (Mn) may be essential to increase the strength of steel, and may increase the strength of steel after a quenching heat treatment of steel. When a content thereof is less than 0.7%, it may be difficult to secure sufficient strength of 1800 Mpa or higher after a tempering heat treatment, whereas, when the content exceeds 1.5%, a segregation region may be formed internally and/or externally of a continuous casting slab and a hot-rolled steel sheet, and a high frequency of process defect may occur when a steel pipe is made. Also, fatigue durability causing an increase of strength may be deteriorated after an excessive tempering heat treatment. Thus, it may be preferable to limit a content of manganese (Mn) to 0.7-1.5%.

Si: 0.3% or Less (Excluding 0%)

Silicon (Si) may be added to improve strength or ductility, and may be added in a range in which no problem occurs in relation to surface scale properties of a hot-rolled steel sheet and a hot-rolled pickled steel sheet. When a content thereof exceeds 0.3% or higher, silicon oxide may be formed such that a surface defect may occur, which may not easily be removed by pickling. Thus, the content may be limited to 0.3% (excluding 0%).

P: 0.03% or Less (Including 0%)

Phosphorus (P) may be segregated on an austenite grain boundary and/or an interphase boundary and may cause embrittlement. Accordingly, a content of phosphorus (P) may be maintained to be low as possible, and an upper limit thereof may be limited to 0.03%. A preferable content of phosphorus (P) may be 0.02% or less. In the present disclosure, as a presence of S element has been observed at a position of steel at which quenching cracks may occur in quenching, phosphorus (P) may be managed less rigidly as compared to a content of P. However, a defect may be caused on an internal wall of a steel pipe due to P element remaining in an inappropriate pickling process after a pipe phosphate ($H_3PO_4$) process performed to remove a scale in a pipe drawing manufacturing process. Thus, it may be preferable to control a content of a P element to be low.

S: 0.004% or Less (Including 0%)

Sulfur (S) may be segregated in an MnS non-metal inclusion or in continuous casting solidifying and may cause high temperature cracks. Also, as sulfur (S) may deteriorate impact toughness of a heat treatment steel sheet or a steel pipe, it may be necessary to control a content thereof to be low as possible. Thus, a content of sulfur (S) may be maintained to be low as possible, and it may be preferable to limit an upper limit thereof to 0.004%.

Al: 0.04% or Less (Excluding 0%)

Aluminum (Al) may be added as a deoxidizer. Meanwhile, aluminum (Al) may react with nitrogen (N) in steel and AlN may be precipitated, and when a thin slab is manufactured, slab cracks may be created under a casting slab cooing condition in which the precipitates are precipitated such that quality of a casting slab or a hot-rolled steel sheet may be deteriorated. Thus, it may be preferable to limit a content of aluminum (Al) to 0.04% or less (excluding 0%).

Cr: 0.3% or Less (Excluding 0%)

Chromium (Cr) may delay transformation of ferrite of austenite such that chromium (Cr) may increase hardenability in a quenching heat treatment of steel and may improve heat treatment strength. When higher than 0.3% of chromium (Cr) is added to steel containing 0.35% or higher of carbon (C), steel may have excessive hardenability. Thus, a content thereof may be limited to 0.3% or less (excluding 0%).

Mo: 0.3% or Less (Excluding 0%)

Molybdenum (Mo) may increase hardenability of steel, and may form a fine precipitate such that a grain of austenite may be refined. Also, molybdenum (Mo) may be effective for improving strength after a heat treatment of steel and improving toughness, but when a content thereof exceeds 0.3%, manufacturing costs of steel may increase. Thus, the content may be limited to 0.3% or less (excluding 0%).

In the present disclosure, one or two of Ni and Cu may be contained.

Ni: 0.1-1.0%

Nickel (Ni) may increase both hardenability and toughness of steel. In the present disclosure, when tensile properties is examined after a heat treatment of a steel sheet of a steel pipe in which a content of nickel (Ni) has been increased in a basic composition, strength after a heat treatment may decrease according to an increase of a content of Ni, and that is because, presumably, nickel (Ni) element may facilitate the movement of dislocation included in martensite. When a content thereof is less than 0.1%, the effect of increasing hardenability and toughness may not be sufficient, whereas, when the content exceeds 1.0%, manufacturing costs of a steel sheet may rapidly increase in spite of the above-described advantages, and also, weldability for manufacturing a steel pipe may be deteriorated. Also, an increase of a content of Ni may prevent diffusion of hydrogen thickened on a surface of a heat treatment component and flowing into the component and/or may prevent permeation of hydrogen by forming a close corrosion product (Cu—Ni rich FeOOH) in an corrosion environment, thereby increasing resistance to stress corrosion crack, which may be an advantageous effect. Thus, the content may be limited to a range of 0.1-1.0%.

Cu: 0.1-1.0%

Copper (Cu) may increase corrosion resistance of steel and may effectively increase quenching and quenching-tempering strength after a heat treatment. When a content thereof is less than 0.1%, it may be difficult to secure the above-described effect, whereas, when the content exceeds 1.0%, cracks may be created on a hot-rolled steel sheet such that a manufacturing yield of a steel sheet may decrease or strength after a heat treatment may rapidly increase, which may cause cracks, or strength after a heat treatment may rapidly increase, which may decrease toughness. Thus, the content may be limited to a range of 0.1-1.0%. Meanwhile, as copper (Cu) may cause surface cracks of a hot-rolled steel sheet, it may be preferable to use copper (Cu) with nickel (Ni) element, rather than using copper (Cu) alone.

Cu+Ni: 0.4% or Higher

Cu+Ni may be important to increase rust resistance and toughness of a steel sheet and a steel pipe.

In the present disclosure, when less than 0.4% of Cu+Ni is added to steel containing 0.35% or higher of carbon (C), it may be difficult to secure both of the effects described above. Thus, a content of Cu+Ni may be 0.4% or higher. Also, when a heat treatment is performed to a steel sheet or a steep pipe component in which 0.4% or higher of Cu+Ni is added to steel containing an appropriate content of carbon (C) and manganese (Mn), advantageous effects, such as reduction of a depth of a decarburization layer formed on a surface layer of a steel sheet of a steep pipe component, improvement of impact toughness, rust resistance, and the like, has been obtained. Particularly, an increase of a depth of a decarburization layer may work as a factor which may deteriorate fatigue durability capability of a steep pipe component. Thus, a content of Cu+Ni may be limited to 0.4% or higher.

N: 0.006% or Less (Excluding 0%)

Nitrogen (N) may stabilize austenite and may form nitride. When a content of nitrogen (N) exceeds 0.006%, coarse AlN nitride may be formed, which may work as a fatigue crack generation point and may deteriorate fatigue durability, when furnace durability of a hot-rolled steel sheet or a steel pipe component is tested. Thus, a content thereof may be limited to 0.006% or less (excluding 0%).

Also, when boron (B) is also added, it may be necessary to control a content of nitrogen (N) to be low to increase an effective boron (B) content.

Mn and Si may need to satisfy relational formula 1 as below:

$$(Mn/Si) \geq 3 \text{ (a weight ratio)} \quad \text{[Relational Formula 1]}$$

The Mn/Si ratio may be an important parameter which may determine quality of a welded zone of a steel pipe. When the Mn/Si ratio is less than 3, a content of Si may be relatively high such that silicon oxide is formed in a molten metal of a welded zone, and in the case in which the element is not forcibly discharged, a defect may be formed in the welded zone, which may cause a defect in steep pipe making. Thus, the Mn/Si ratio may be limited to 3 or higher.

C, Mn, Ni, and Cu may need to satisfy relational formula 2 as below:

$$(Ni+Cu)/(C+Mn) \geq 0.2 \text{ (a weight ratio)} \quad \text{[Relational Formula 2]}$$

The (Ni+Cu)/(C+Mn) ratio may be a condition required to secure strength after a quenching or quenching-tempering heat treatment and to secure a satisfactory level of impact toughness and hydrogen embrittlement resistance. When the (Ni+Cu)/(C+Mn) ratio is less than 0.2, quenching cracks may be created in water, water+oil, or oil quenching, or hydrogen delayed fracture may occur in a steel pipe or a steel pipe component in the case in which a lengthy natural aging process is not performed after quenching. When the (Ni+Cu)/(C+Mn) ratio exceeds 0.2, hydrogen delayed fracture may be effectively prevented even with a natural aging process performed for a short time in the quenching of steel, which may be an advantage.

Ni and Si may need to satisfy relational formula 3 as below:

$$(Ni/Si) \geq 1 \text{ (a weight ratio)} \quad \text{[Relational Formula 3]}$$

The Ni/Si ratio may be an important parameter which affect quenching strength according to a quenching heat treatment of steel or tempering strength according to a quenching-tempering heat treatment. The present disclosure may be characterized by adding a relatively great content of nickel (Ni) element, rather than silicon (Si) element. When the Ni/Si ratio is less than 1, a content of silicon (Si) may be relatively high in steel such that strength of a hot-rolled steel sheet may be relatively high. Accordingly, when deformation resistance of a material increases in relation to hot-rolling, there may be a difficulty in manufacturing a hot-rolled steel sheet having a thin thickness, a thickness of less than 3 mm, for example. When the Ni/Si ratio is 1 or greater, a content of Ni may be relatively high such that strength of a hot-rolled steel sheet may be relatively low, and quenching strength and quenching-tempering strength may be relatively low, and accordingly, it may be advantageous to securing toughness of a hot-rolled steel sheet or a steel pipe component. Also, as a fraction of retained austenite remaining in a martensite or tempered martensite structure phase according to quenching or quenching-tempering heat treatment may be relatively small, a threshold content of diffusible hydrogen collected on an austenite/base iron interfacial surface may be high, and also, as the amount of hydrogen permeated into a hot-rolled steel sheet or a steel pipe component may be relatively highly prevented, presumably, resistance to hydrogen embrittlement may further improve. Also, an increase of a content of retained austenite in martensite or tempered martensite may be a factor which may decrease durability of steel. Thus, the Ni/Si ratio may be limited to 1 or greater.

In the present disclosure, Fe and other impurities may be included in addition to the above-described composition.

Also, another alloy element may be additionally added to the steel having the composition as above for further property improvement.

In the present disclosure, one or two or more selected from a group consisting of 0.04% or less (excluding 0%) of Ti, 0.005% or less (excluding 0%) of B, and 0.03% or less (excluding 0%) of Sb may be additionally included if necessary.

Ti: 0.04% or Less (Excluding 0%)

Titanium (Ti) may form a precipitate (TiC, TiCN, or TiNbCN) in a hot-rolled steel sheet, and may increase strength of a hot-rolled steel sheet by preventing growth of an austenite grain.

When a content thereof exceeds 0.04%, it may be effective for increasing strength of steel to which a quenching-tempering heat treatment has been performed and collecting diffusible hydrogen on a TiN interfacial surface. However, when titanium (Ti) is present in a hot-rolled steel sheet in a form of coarse crystallized product, not a fine precipitate, titanium (Ti) may degrade toughness or may work as a fatigue crack generation point such that fatigue durability of a hot-rolled steel sheet and a steel pipe component may decrease. Thus, a content thereof may be limited to 0.04% or less (excluding 0%).

B: 0.005% or Less (Excluding 0%)

Boron (B) may be an advantageous element which may greatly increase hardenability of steel even with a low content thereof. When an appropriate content of boron (B) is added, boron (B) may prevent the formation of ferrite, which may be effective for increasing hardenability. However, when boron (B) is excessively added, boron (B) may increase an austenite recrystallization temperature and may degrade weldability. When a content of boron (B) exceeds 0.005%, the above-described effect may be saturated or it may be difficult to secure appropriate strength and toughness. Thus, a content thereof may be limited to 0.005% or less. It may be more preferable to limit the content to 0.003% or less to secure both strength and toughness of heat treatment steel more effectively.

Sb: 0.03% or Less (Excluding 0%)

Antimony (Sb) may be advantageous to preventing a surface layer decarburization of a high-carbon hot-rolled steel sheet. When an appropriate content of antimony (Sb) is added, antimony (Sb) may be thickened on a surface layer of a hot-rolled steel sheet and may be effective for preventing surface layer decarburization of the steel sheet. However, when antimony (Sb) is excessively added, antimony (Sb) may decrease high temperature ductility of steel in a process of cooling a steel slab such that cracks may be created on a slab corner portion, which may degrade surface quality of the slab. When a content of antimony (Sb) exceeds 0.03%, the effect of preventing decarburization may be saturated, or surface quality of a slab may be degraded such that a defect may occur on a surface of a hot-rolled steel sheet, which may decrease a yield of a hot-rolled coil. Thus, the content may be limited to 0.03% or less. More preferably, it may be more effective to limit the content to 0.02% or less to prevent surface decarburization and to also secure surface quality of a slab or a hot-rolled steel sheet.

The hot-rolled steel sheet having excellent impact resistance and rust resistance according to an aspect of the present disclosure may have a microstructure including, by volume %, 10-30% of ferrite and 70-90% of pearlite. When a fraction of ferrite is less than 10%, a content of pearlite may excessively increase such that strength may increase, which may cause a difficulty in manufacturing a thin steel sheet having a thickness of 3 mm or less, for example. Thus, it may be preferable to limit a fraction of ferrite to 10% or higher. A preferable ferrite fraction may be 10-30%.

The hot-rolled steel sheet may have a thickness of 2-7 mm.

The hot-rolled steel sheet may tensile strength of 600-1000 Mpa.

In the description below, a method of manufacturing a hot-rolled steel sheet having excellent impact resistance and rust resistance according to an aspect of the present disclosure will be described.

The method of manufacturing a hot-rolled steel sheet having excellent impact resistance and rust resistance according to an aspect of the present disclosure may include heating a steel slab including, by weight %, 0.35-0.55% of C, 0.7-1.5% of Mn, 0.3% or less (excluding 0%) of Si, 0.03% or less (including 0%) of P, 0.004% or less (including 0%) of S, 0.04% or less (excluding 0%) of Al, 0.3% or less (excluding 0%) of Cr, 0.3% or less (excluding 0%) of Mo, one or two of 0.1-1.0% of Ni and 0.1-1.0% of Cu, 0.4% or more of Cu+Ni, 0.006% or less (excluding 0%) of N, and a balance of Fe and other impurities, the alloy elements satisfying relational formulae 1-3 as below, within a temperature range of 1150-1300° C.;

$$(Mn/Si) \geq 3 \text{ (a weight ratio)} \quad \text{[Relational Formula 1]}$$

$$(Ni+Cu)/(C+Mn) \geq 0.2 \text{ (a weight ratio)} \quad \text{[Relational Formula 2]}$$

$$(Ni/Si) \geq 1 \text{ (a weight ratio)} \quad \text{[Relational Formula 3]}$$

obtaining a hot-rolled steel sheet by hot-rolling, including rough-rolling and finishing-rolling, the heated slab at a temperature of Ar3 or higher; and cooling the hot-rolled steel sheet on a run-out table and coiling the hot-rolled steel sheet at a temperature of 550-750° C.

Heating Steel Slab

The steel slab having a composition as above may be heated within a temperature range of 1150-1300° C.

The heating the steel slab within a temperature range of 1150-1300° C. is for the slab to have a uniform structure and composition distribution therein. When a slab heating temperature is low, less than 1150° C., a precipitate formed in a continuous casting slab may not be solid solute, and composition uniformity may not be secured.

When the slab heating temperature exceeds 1300° C., a decarburization depth may excessively increase and grain growth may occur such that it may be difficult to secure target mechanical property and surface quality of a hot-rolled steel sheet. Thus, the slab heating temperature may be limited to 1150-1300° C.

Obtaining Hot-Rolled Steel Sheet

A hot-rolled steel sheet may be obtained by hot-rolling, including rough-rolling and finishing-rolling, the heated slab at a temperature of Ar3 or higher.

In the hot-rolling, a hot-finishing rolling process may be performed at Ar3 or higher preferably. When the hot-rolling is performed at a temperature less than Ar3, austenite may partially be transformed to ferrite such that transformation resistance of a material in relation to the hot-rolling may become non-uniform, and passing ability including straightness of the steel sheet may degrade, and accordingly, it may be highly likely that a workability defect such as fracture of a sheet, and the like, may occur. Particularly, when a finishing rolling temperature exceeds 950° C., a scale defect, and the like, may occur, and thus, it may be preferable to limit the finishing rolling temperature to 950° C. or less.

Coiling

The hot-rolled steel sheet obtained through the hot-rolling may be cooled at a run-out table and may be coiled at a temperature of 550-750° C.

The cooling at a run-out table and the coiling at a temperature range of 550-750° C. after the hot-rolling may be performed to secure uniform mechanical property of the hot-rolled steel sheet. When the coiling temperature is excessively low, less than 550° C., a low temperature transformation phase such as bainite or martensite may be formed on an edge portion of the steel sheet in a width direction such that there may be a concern that strength of the steel sheet may rapidly increase, and deviation in hot-rolling strength may increase in the width direction.

When the coiling temperature exceeds 750° C., internal oxidization may be encouraged on a surface layer of the steel sheet, and after a hot-rolling pickling process, a surface flaw such as cracks, or surface serrations may be created on a surface. Also, deviation in surface hardness of the steel sheet may occur due to coarse pearlite. Thus, the coiling temperature after the cooling of the hot-rolled steel sheet may be limited to 550-750° C.

In the present disclosure, the hot-rolled steel sheet manufactured as above may also be manufactured as a hot-rolled pickled steel sheet by performing an additional pickling process to the steel sheet. As a method of the pickling process, any pickling method generally used in a hot-rolling pickling process may be used, and thus, the method of the pickling process is not limited to any particular method.

According to the method of manufacturing a hot-rolled steel sheet having excellent impact resistance and rust resistance according to a preferable aspect of the present disclosure, a hot-rolled steel sheet having a microstructure including, by volume %, 10% or higher of ferrite and 90% or less of pearlite may be manufactured.

The hot-rolled steel sheet may have a thickness of 2-7 mm.

The hot-rolled steel sheet may tensile strength of 600-1000 Mpa.

In the description below, a steel pipe and a method of manufacturing the same will be described according to another preferable aspect of the present disclosure.

The steel pipe according to another preferable aspect of the present disclosure may be manufactured using the hot-rolled steel sheet of the present disclosure described above, and may have the alloy composition of the hot-rolled steel sheet of the present disclosure described above, and a microstructure including, by volume %, 10-60% of ferrite and 40-90% of pearlite. Preferably, a microstructure of the steel pipe may include 20-60% of ferrite by volume %.

The method of manufacturing a steel pipe according to another preferable aspect of the present disclosure may be a method of manufacturing a steel pipe using the hot-rolled steel sheet manufactured by the method of manufacturing a hot-rolled steel sheet of the present disclosure described above.

The method of manufacturing a steel pipe according to another preferable aspect of the present disclosure may include obtaining a steel pipe by welding the hot-rolled steel sheet manufactured by the method of manufacturing a hot-rolled steel sheet of the present disclosure described above; and performing an annealing heat treatment on the steel pipe.

Obtaining Steel Pipe

A steel pipe may be obtained by welding the hot-rolled steel sheet manufactured by the method of manufacturing a hot-rolled steel sheet of the present disclosure described above.

The steel pipe may be obtained by pipe making through electric resistance welding or induction heating welding, for example, using the hot-rolled steel sheet or the hot-rolled pickled steel sheet.

Annealing Heat Treatment of Steel Pipe

An annealing heat treatment may be performed to the steel pipe obtained by the pipe making as above.

The present disclosure may further include drawing the steel pipe to which the annealing heat treatment has been performed. A pipe diameter may be reduced by cold-drawing the steel pipe. As a method of the drawing, a cold-drawing method may be used.

In the present disclosure, a steel pipe having a small diameter may be manufactured using a general cold-forming method including pipe-making, annealing heating, and cold-drawing the steel pipe through electric resistance welding or induction heating welding, for example, using the hot-rolled steel sheet or the hot-rolled pickled steel sheet.

It may be preferable to perform the annealing heat treatment of the steel pipe at a temperature of Ac1−50° C.-Ac3+150° C. for 3-60 minutes. The annealing heat treatment may include furnace-cooling and air-cooling. When the annealing heat treatment temperature is excessively low or the time is not sufficient, a pearlite band structure may be formed in a microstructure of the steel pipe, and a cold-shaft size rate or a cross-sectional area reduction rate of the steel pipe may decrease. When the annealing heat treatment temperature is excessively high or the annealing heat treatment is performed for a long time, a coarse spherical phase Fe3C may be formed in a microstructure of the steel pipe or decarburization may occur on a surface layer or an internal wall layer of the steel sheet.

In the description below, a member and a method of manufacturing the same will be described according to another preferable aspect of the present disclosure.

A member according to another preferable aspect of the present disclosure may be manufactured using the steel pipe of the present disclosure described above, and the member may have an alloy component of the steel pipe of the present disclosure described above, and may have a microstructure including one or two of 90% or more of martensite and tempered martensite and 10% or less of retained austenite.

When a fraction of martensite and tempered martensite is less than 90%, there may be a problem in which it may be difficult to secure target yield strength of 1400 MPa or higher or target tensile strength of 1800 MPar higher. When a content of the retained austenite exceeds 10%, resistance to hydrogen delayed fracture may increase through collection of diffusible hydrogen, but the retained austenite may work as a fatigue crack site such that fatigue durability may decrease.

The member according to another preferable aspect of the present disclosure may have yield strength of 1400 MPa or higher and tensile strength of 1800 MPa or higher.

The member according to another preferable aspect of the present disclosure may have ultra-high strength after a heat treatment enabling excellent impact resistance and rust resistance such that no pre-breakage or abnormal fracturing occurs in a tensile test with a natural aging time of less than 45 hr.

The method of manufacturing the member according to another preferable aspect of the present disclosure may include performing an annealing heat treatment on the steel pipe and drawing the steel pipe; obtaining the member by hot-rolling the drawn steel pipe; and quenching, or quenching and tempering the member.

Obtaining Member

The member may be obtained by forming the drawing steel pipe.

The forming the steel pipe may be performed by a method of heating the steel pipe at a high temperature and hot-forming the steel pipe, for example. An example of the member may be a suspension component.

In the hot-forming the steel pipe, a steel pipe having a certain length may be heated at a temperature range of 900-980° C., the steel pipe may be isothermally maintained within 60-1000 seconds, and the steel pipe may be extracted and may be hot-formed using a die, or the like, thereby obtaining the member.

The heating the steel pipe at a temperature range of 900-980° C. may be to make a microstructure of the steel pipe component austenite and to make the composition uniform. When a heating temperature of the steel pipe is less than 900° C., a decrease of temperature in a process of the hot-forming and a quenching heat treatment may be significant, and ferrite may be formed on a surface of the steel pipe such that it may be difficult to secure sufficient strength after a heat treatment. When the heating temperature exceeds 980° C., a size of an austenite grain of the steel pipe may increase or decarburization may occur on an internal/external wall of the steel pipe such that fatigue strength of a final component may decrease.

Further, when the steel pipe is heated at the above-mentioned temperature or higher, it may be difficult to secure target strength after a heat treatment of the final component. Thus, it may be preferable to limit the heating temperature of the steel pipe to a temperature range of 900-980° C.

Also, to secure sufficient heat treatment strength and to prevent decarburization, a heating heat treatment may be performed for the time of range of 60-1000 sec. When the heating (maintaining) time is less than 60 sec, it may be difficult to secure the uniform composition distribution and structure. When the steel pipe is heated and maintained for longer than 1000 sec, there may be a difficulty in preventing grain growth or decarburization.

Thus, it may be preferable to limit the time of maintaining the steel pipe at the above-mentioned heating temperature to a range of 60-1000 sec.

Quenching or Quenching and Tempering Member

The member obtained by the hot-forming may be quenched or quenched and tempered.

The heating temperature of the quenching process may be 900-980° C.

In the quenching process, the hot-formed member may, for example, be cooled to 200° C. or lower to form a martensite phase structure by directly submerging the member in water or oil refrigerant and performing water cooling or oil cooling.

A quenching heat treatment may be performed to the member obtained by the hot-forming using water or a water+oil mixture or oil refrigerant, and this process may be performed for a structure of the hot-formed member (component) to have a martensite phase, and the hot-formed component may be submerged in refrigerant and quenched (rapidly cooled) to allow a temperature of the member (component) to be 200° C. or lower. In this case, a cooling rate may be 10-70° C./sec at a temperature range section of Ms (a martensite transformation initiation temperature)-Mf (a martensite transformation termination temperature).

When the cooling rate is less than 10° C./sec in the Ms-Mf temperature range section, it may be difficult to form a martensite phase. When the cooling rate exceeds 70° C./sec, a martensite phase may be excessively formed due to deviation in the rapid cooling between internal/external walls of the steel pipe such that a size defect in which a shape of the member (component) changes, or a component manufacturing defect such as quenching cracks may easily occur. Particularly, the above-mentioned issues may greatly occur in a steel sheet or a member (component) exhibiting tensile properties after a heat treatment of 1800 MPa or higher. To significantly reduce the component manufacturing defect, it may be preferable to limit the cooling rate of the member in the Ms-Mf temperature section to 10-70° C./sec.

Also, it may be more preferable to limit the cooling rate to a range of 20-60° C./sec to efficiently secure tensile strength after a heat treatment of the member. Meanwhile, to secure the above-mentioned cooling rate, a temperature of water, oil+water, or oil cooling medium may be increased from room temperature to a high temperature.

In the present disclosure, the member may be only be quenched as above, but after the quenching process as above, the member may also be tempered to provide toughness.

The tempering process may be performed by maintaining the member (component) at a tempering temperature of 150-230° C. for 120-3600 seconds.

When the tempering temperature is less than 150° C., strength after a heat treatment may be high, but room temperature impact toughness may be excessively low. When the tempering temperature exceeds 230° C., temper embrittlement in which a total elongation rate or a uniform elongation rate of the member may rapidly decrease may occur. Also, there may be a difficulty in securing target strength after a heat treatment, or an alloy element may need to be added to secure sufficient hardenability to secure target strength after a heat treatment, but it may be recommendable in an economic sense. Also, it may be difficult to secure target strength. Thus, it may be preferable to limit the tempering temperature to 150-230° C.

To secure sufficient strength after a heat treatment and impact toughness, it may be preferable to maintain the member at a tempering temperature of 150-230° C. for 120-3600 sec.

When the maintaining time is less than 120 sec, there may be no significant change in dislocation density included in a martensite structure phase of the member to which the quenching heat treatment has been performed such that yield strength may be low and tensile strength may excessively high, and accordingly, impact toughness may be insufficient. When the maintaining time exceeds 3600 sec, relatively satisfactory impact toughness may be secured, but there may be a difficulty in securing strength after a heat treatment. Thus, it may be preferable to limit the maintaining time at a tempering temperature to a range of 120-3600 sec.

According to the method of manufacturing the member of the present disclosure, a member having excellent impact resistance and rust resistance with no pre-breakage and abnormal fracturing in a tensile test even with a relatively short natural aging time of less than 45 hr may be manufactured.

Mode for Invention

In the description below, the present disclosure will be described in greater detail through an embodiment.

Embodiment

A hot-rolled steel sheet having a thickness of 3 mm was manufacturing by hot-rolling steel having a component as in Tables 1 and 2 under the conditions as in Table 3 and was pickled. An on-site slab manufactured before the hot-rolling or a lab-manufactured ingot was heated at a range of 1200±20° C. for 200 minutes and was homogenized, and as a subsequent process, rough-rolling and finishing-rolling were performed to an individual slab or an ingot, and the individual slab or an ingot was coiled at a temperature of 600-700° C., thereby manufacturing a hot-rolled steel sheet having a thickness of 3 mm.

In Tables 1 and 2 below, inventive steels (1-14) satisfied relational formulae (1)-(3), and Cu+Ni satisfied 0.4 or higher. Comparative steels (1-7) did not satisfy at least one of relational formulae (1)-(3). An Ms temperature was calculated using Ms=539−423C−30.4Mn−12.1Cr−17.7Ni−7.5Mo as an empirical formula.

A microstructure, yield strength (YS), tensile strength (TS), and an elongation rate (EL) were measured with respect to the hot-rolled steel sheet manufactured as above, and a result of the measurement was listed in Table 3. A microstructure other than ferrite was pearlite.

The hot-rolled steel sheet was pickled, and a partial member was manufactured as a steel pipe having a diameter of 28 mm using electric resistance welding, and an annealing heat treatment and cooling drawing were performed to manufacture a drawn steel pipe having a diameter of 23.5 mm. In this case, an annealing temperature was 721° C. Heating-hot rolling-quenching heat treatment or heating-hot rolling-quenching-tempering heat treatment was performed to the steel pipe under the conditions as in Table 4, thereby manufacturing a member.

In the quenching, the member was heated at a temperature of 930-950° C., and was submerged in an oil refrigerant for 200 sec to cool the member to 200° C. or lower, to completely cool the member to room temperature as possible.

After the quenching heat treatment, whether cracks were created in the member was examined, and a result of the examination was listed in Table 4. Whether cracks were created was indicated as cracks created: O, no cracks created: X, no cracks created: X (after a natural aging time), and the like.

Yield strength (YS), tensile strength (TS), an elongation rate (EL), a yield ratio (YR), and impact energy were measured with respect to the member manufactured as above, and a result of the measurement was listed in Table 5.

Also, corrosion resistance (rust), a microstructure, and a surface layer decarburization depth were measured with respect to the member manufactured as above, and a result of the measurement was listed in Table 6.

Mechanical property values of the hot-rolled steel sheet and the member were measured by taking JIS 5 sample at a point of a width w/4 in a direction parallel to a rolling direction.

Sensitivity to quenching cracks and hydrogen embrittlement was a result of conducting a tensile test on a sample to which an individual quenching heat treatment was performed while varying a natural aging time.

A room temperature impact test value was obtained by size-processing a sample on which a quenching heat treatment was performed with a sub-size thickness according to the ASTM E23 standard, and surface grinding-off was performed on both surfaces of the sample to remove a decarburization layer.

A result of a rust test was obtained by spraying water to a surface of a sample of a steel pipe or a plate sample before/after a heat treatment of individual steel types, exposing the sample to air, and measuring the time for which rust was formed on the surface of the sample. The result may be considered as an indirect evidence by which a degree of corrosion resistance of steel type may be determined.

A microstructure of the member was measured using a quantitative analysis device including an optical microscope, a scanning electron microscope, a transmission electron microscope, and an electron back scattering diffraction (EBSD).

A depth of a decarburization layer was measured by dividing decarburization into ferrite decarburization (complete decarburization) and total decarburization.

A natural aging process was performed for 45 hr and a tensile test was performed with respect to inventive materials (4, 6, and 15) and comparative material (3), and a result thereof was listed in Table 1.

Also, distribution of copper (Cu) and nickel (Ni) elements was examined with respect to hot-rolled steel sheets of inventive materials (4) and (12), and results of the examinations were listed in Tables 2 and 3, respectively.

Also, microstructures before and after a heat treatment of a drawn pipe of inventive material (4) were observed, and a result of the observation was listed in Table 4. In FIGS. 4(*a*) and 4(*b*), (*a*) shows a microstructure of the drawn pipe before a heat treatment, and (*b*) shows a microstructure of the drawn pipe after a heat treatment.

TABLE 1

| Steel Type | C | Si | Mn | P | S | S.Al | Cr | Mo | Ti | Cu | Ni | B | N |
|---|---|---|---|---|---|---|---|---|---|---|---|---|---|
| Inventive Steel 1 | 0.405 | 0.247 | 1.290 | 0.0150 | 0.0020 | 0.033 | 0.147 | 0.148 | 0.038 | 0.103 | 0.306 | 0.0026 | 0.0040 |
| Inventive Steel 2 | 0.405 | 0.255 | 1.300 | 0.0170 | 0.0022 | 0.031 | 0.147 | 0.147 | 0.040 | 0.106 | 0.870 | 0.0026 | 0.0036 |
| Inventive Steel 3 | 0.420 | 0.094 | 1.330 | 0.0100 | 0.0020 | 0.028 | 0.200 | 0.151 | 0.030 | 0.300 | 0.155 | 0.0021 | 0.0039 |
| Inventive Steel 4 | 0.427 | 0.093 | 1.310 | 0.0095 | 0.0022 | 0.0333 | 0.199 | 0.149 | 0.030 | 0.299 | 0.310 | 0.0021 | 0.0044 |
| Inventive Steel 5 | 0.427 | 0.095 | 1.000 | 0.0096 | 0.0020 | 0.028 | 0.197 | 0.101 | 0.030 | 0.095 | 0.710 | 0.002 | 0.0036 |
| Inventive Steel 6 | 0.420 | 0.095 | 1.000 | 0.0090 | 0.0018 | 0.022 | 0.198 | 0.102 | 0.028 | 0.096 | 0.924 | 0.0018 | 0.0032 |
| Inventive Steel 7 | 0.420 | 0.091 | 1.010 | 0.0100 | 0.0015 | 0.033 | 0.198 | 0.100 | 0.030 | 0.710 | 0.100 | 0.0021 | 0.0035 |
| Inventive Steel 8 | 0.425 | 0.092 | 1.030 | 0.0100 | 0.0017 | 0.031 | 0.201 | 0.104 | 0.032 | 0.916 | 0.098 | 0.0021 | 0.0042 |
| Inventive Steel 9 | 0.416 | 0.089 | 1.010 | 0.0095 | 0.0017 | 0.022 | 0.198 | 0.100 | 0.001 | 0.105 | 0.905 | 0.0019 | 0.0033 |

TABLE 1-continued

| Steel Type | C | Si | Mn | P | S | S.Al | Cr | Mo | Ti | Cu | Ni | B | N |
|---|---|---|---|---|---|---|---|---|---|---|---|---|---|
| Inventive Steel 10 | 0.425 | 0.092 | 1.020 | 0.0090 | 0.0021 | 0.033 | 0.197 | 0.102 | 0.031 | 0.101 | 0.923 | 0.0003 | 0.0044 |
| Inventive Steel 11 | 0.423 | 0.091 | 1.320 | 0.0095 | 0.002 | 0.033 | 0.200 | 0.149 | 0.030 | 0.299 | 0.910 | 0.0020 | 0.0037 |
| Inventive Steel 12 | 0.412 | 0.092 | 1.310 | 0.0090 | 0.0026 | 0.025 | 0.199 | 0.150 | 0.029 | 0.300 | 0.903 | 0.0021 | 0.0043 |
| Inventive Steel 13 | 0.412 | 0.092 | 1.000 | 0.0095 | 0.0020 | 0.032 | 0.196 | 0.147 | 0.029 | 0.293 | 0.901 | 0.0021 | 0.0043 |
| Inventive Steel 14 | 0.544 | 0.093 | 0.909 | 0.0090 | 0.0019 | 0.026 | 0.200 | 0.100 | 0.030 | 0.101 | 0.915 | 0.0019 | 0.0036 |
| Comparative Steel 1 | 0.402 | 0.098 | 1.300 | 0.0090 | 0.0022 | 0.030 | 0.200 | 0.148 | 0.029 | 0.000 | 0.000 | 0.0019 | 0.0053 |
| Comparative Steel 2 | 0.450 | 0.360 | 0.809 | 0.0090 | 0.0019 | 0.031 | 0.195 | 0.001 | 0.030 | 0.300 | 0.310 | 0.0019 | 0.0041 |
| Comparative Steel 3 | 0.430 | 0.632 | 0.535 | 0.0110 | 0.0020 | 0.030 | 0.160 | 0.160 | 0.030 | 0.110 | 0.517 | 0.0022 | 0.0042 |
| Comparative Steel 4 | 0.412 | 0.108 | 1.320 | 0.0095 | 0.0020 | 0.024 | 0.203 | 0.149 | 0.030 | 0.200 | 0.100 | 0.0021 | 0.0055 |
| Comparative Steel 5 | 0.410 | 0.260 | 1.340 | 0.0100 | 0.0023 | 0.007 | 0.15 | 0.153 | 0.042 | 0.110 | 0.103 | 0.0026 | 0.0047 |
| Comparative Steel 6 | 0.420 | 0.095 | 1.320 | 0.0090 | 0.0020 | 0.025 | 0.199 | 0.150 | 0.029 | 0.001 | 0.000 | 0.0020 | 0.0034 |
| Comparative Steel 7 | 0.438 | 0.099 | 1.310 | 0.0100 | 0.0020 | 0.030 | 0.199 | 0.149 | 0.029 | 0.002 | 0.001 | 0.0020 | 0.0041 |

TABLE 2

| Steel Type | Relational Formula (1) (Mn/Si) | Relational Formula (2) (Cu + Ni)/(C + Mn) | Relational Formula (3) (Ni/Si) |
|---|---|---|---|
| Inventive Steel 1 | 5.2 | 0.24 | 1.24 |
| Inventive Steel 2 | 5.1 | 0.57 | 3.41 |
| Inventive Steel 3 | 14.1 | 0.26 | 1.65 |
| Inventive Steel 4 | 14.1 | 0.35 | 3.33 |
| Inventive Steel 5 | 10.5 | 0.56 | 7.47 |
| Inventive Steel 6 | 10.5 | 0.72 | 9.73 |
| Inventive Steel 7 | 11.1 | 0.57 | 1.10 |
| Inventive Steel 8 | 11.2 | 0.70 | 1.07 |
| Inventive Steel 9 | 11.3 | 0.71 | 10.17 |
| Inventive Steel 10 | 11.1 | 0.71 | 10.03 |
| Inventive Steel 11 | 14.5 | 0.69 | 10.00 |

TABLE 2-continued

| Steel Type | Relational Formula (1) (Mn/Si) | Relational Formula (2) (Cu + Ni)/(C + Mn) | Relational Formula (3) (Ni/Si) |
|---|---|---|---|
| Inventive Steel 12 | 14.2 | 0.70 | 9.82 |
| Inventive Steel 13 | 10.9 | 0.85 | 9.79 |
| Inventive Steel 14 | 9.8 | 0.70 | 9.84 |
| Comparative Steel 1 | 13.3 | 0.00 | 0.00 |
| Comparative Steel 2 | 2.2 | 0.48 | 0.86 |
| Comparative Steel 3 | 0.8 | 0.65 | 0.82 |
| Comparative Steel 4 | 12.2 | 0.17 | 0.93 |
| Comparative Steel 5 | 5.2 | 0.12 | 0.40 |
| Comparative Steel 6 | 13.9 | 0.00 | 0.00 |
| Comparative Steel 7 | 13.2 | 0.00 | 0.01 |

TABLE 3

| Steel Type | Sample No | Slab Heating Temperature (° C.) | Finishing Rolling Temperature (° C.) | Coiling Temperature (° C.) | Ferrite Fraction (%) | YS (MPa) | TS (MPa) | EL (%) |
|---|---|---|---|---|---|---|---|---|
| Inventive Steel 1 | Inventive Material 1 | 1250 | 880 | 700 | 20.3 | 517 | 753 | 19 |
| Inventive Steel 2 | Inventive Material 2 | 1250 | 880 | 600 | 21.2 | 470 | 723 | 18 |
| Inventive Steel 3 | Inventive Material 3 | 1250 | 880 | 600 | 20.7 | 476 | 715 | 21 |
| Inventive Steel 4 | Inventive Material 4 | 1250 | 880 | 700 | 22.2 | 484 | 714 | 21 |
| Inventive Steel 5 | Inventive Material 5 | 1200 | 880 | 700 | 26.1 | 448 | 680 | 23 |
| Inventive Steel 6 | Inventive Material 6 | 1200 | 880 | 700 | 25.9 | 460 | 701 | 22 |

TABLE 3-continued

| Steel Type | Sample No | Slab Heating Temperature (° C.) | Finishing Rolling Temperature (° C.) | Coiling Temperature (° C.) | Ferrite Fraction (%) | YS (MPa) | TS (MPa) | EL (%) |
|---|---|---|---|---|---|---|---|---|
| Inventive Steel 7 | Inventive Material 7 | 1200 | 880 | 700 | 28.1 | 447 | 674 | 23 |
| Inventive Steel 8 | Inventive Material 8 | 1200 | 880 | 600 | 27.9 | 471 | 705 | 22 |
| Inventive Steel 9 | Inventive Material 9 | 1200 | 880 | 700 | 23.1 | 414 | 652 | 24 |
| Inventive Steel 10 | Inventive Material 10 | 1200 | 880 | 700 | 24.9 | 457 | 693 | 22 |
| Inventive Steel 11 | Inventive Material 11 | 1250 | 880 | 700 | 22.5 | 549 | 789 | 19 |
| Inventive Steel 12 | Inventive Material 12 | 1200 | 880 | 650 | 18.6 | 552 | 790 | 20 |
| Inventive Steel 13 | Inventive Material 13 | 1250 | 880 | 650 | 24.2 | 479 | 706 | 21 |
| Inventive Steel 13 | Inventive Material 14 | 1250 | 880 | 700 | 26.3 | 479 | 706 | 21 |
| Inventive Steel 14 | Inventive Material 15 | 1250 | 880 | 700 | 27.5 | 394 | 645 | 23 |
| Comparative Steel 1 | Comparative Material 1 | 1250 | 880 | 700 | 15.1 | 574 | 781 | 19 |
| Comparative Steel 1 | Comparative Material 2 | 1250 | 880 | 700 | 15.1 | 574 | 781 | 19 |
| Comparative Steel 2 | Comparative Material 3 | 1200 | 880 | 700 | 12.9 | 446 | 725 | 22 |
| Comparative Steel 3 | Comparative Material 4 | 1220 | 880 | 630 | 11.3 | 591 | 829 | 17 |
| Comparative Steel 4 | Comparative Material 5 | 1250 | 880 | 700 | 25 | 547 | 763 | 19 |
| Comparative Steel 5 | Comparative Material 6 | 1250 | 880 | 700 | 20.2 | 561 | 789 | 18 |
| Comparative Steel 6 | Comparative Material 7 | 1250 | 880 | 700 | 21.2 | 413 | 635 | 22 |
| Comparative Steel 7 | Comparative Material 8 | 1250 | 880 | 700 | 27.2 | 420 | 721 | 18 |

TABLE 4

| Steel Type | Sample No. | Heating Temperature (° C.) | Cooling Rate (° C./sec) | Quenching Cracks | Tempering Temperature (° C.) |
|---|---|---|---|---|---|
| Inventive Steel 1 | Inventive Material 1 | 930 | 25 | ○→X (>15 hr) | 200 |
| Inventive Steel 2 | Inventive Material 2 | 930 | 25 | X | 200 |
| Inventive Steel 3 | Inventive Material 3 | 930 | 25 | ○→X (>15 hr) | 200 |
| Inventive Steel 4 | Inventive Material 4 | 930 | 20 | ○→X (>15 hr) | 200 |
| Inventive Steel 5 | Inventive Material 5 | 930 | 50 | X | 220 |
| Inventive Steel 6 | Inventive Material 6 | 950 | 25 | X | 220 |
| Inventive Steel 7 | Inventive Material 7 | 930 | 25 | X | 200 |
| Inventive Steel 8 | Inventive Material 8 | 900 | 25 | X | 220 |
| Inventive Steel 9 | Inventive Material 9 | 930 | 20 | X | 220 |
| Inventive Steel 10 | Inventive Material 10 | 930 | 20 | X | 200 |
| Inventive Steel 11 | Inventive Material 11 | 930 | 20 | X | 200 |
| Inventive Steel 12 | Inventive Material 12 | 930 | 20 | X | 200 |
| Inventive Steel 13 | Inventive Material 13 | 900 | 20 | X | 200 |
| Inventive Steel 13 | Inventive Material 14 | 950 | 50 | ○→X (>15 hr) | — |
| Inventive Steel 14 | Inventive Material 15 | 930 | 20 | X | 200 |

TABLE 4-continued

| Steel Type | Sample No. | Heating Temperature (° C.) | Cooling Rate (° C./sec) | Quenching Cracks | Tempering Temperature (° C.) |
|---|---|---|---|---|---|
| Comparative Steel 1 | Comparative Material 1 | 930 | 20 | ○ | 200 |
| Comparative Steel 1 | Comparative Material 2 | 930 | 20 | ○ | 250 |
| Comparative Steel 2 | Comparative Material 3 | 930 | 20 | ○ | 200 |
| Comparative Steel 3 | Comparative Material 4 | 930 | 25 | ○ | 200 |
| Comparative Steel 4 | Comparative Material 5 | 930 | 20 | ○ | 200 |
| Comparative Steel 5 | Comparative Material 6 | 930 | 20 | ○ | 200 |
| Comparative Steel 6 | Comparative Material 7 | 930 | 20 | ○ | 200 |
| Comparative Steel 7 | Comparative Material 8 | 930 | 20 | ○ | 200 |

TABLE 5

| Steel Type | Sample No. | YS (MPa) | TS (MPa) | EL (%) | YR | Impact Energy (J) |
|---|---|---|---|---|---|---|
| Inventive Steel 1 | Inventive Material 1 | 1491 | 1923 | 8.5 | 0.78 | 27.4 |
| Inventive Steel 2 | Inventive Material 2 | 1500 | 1908 | 8.3 | 0.79 | 30.2 |

TABLE 5-continued

| Steel Type | Sample No. | YS (MPa) | TS (MPa) | EL (%) | YR | Impact Energy (J) |
|---|---|---|---|---|---|---|
| Inventive Steel 3 | Inventive Material 3 | 1594 | 2102 | 9.5 | 0.76 | 30.2 |
| Inventive Steel 4 | Inventive Material 4 | 1514 | 2072 | 9.1 | 0.73 | 33.2 |
| Inventive Steel 5 | Inventive Material 5 | 1508 | 1953 | 9.5 | 0.77 | 24.1 |
| Inventive Steel 6 | Inventive Material 6 | 1474 | 1916 | 9.1 | 0.77 | 28.6 |
| Inventive Steel 7 | Inventive Material 7 | 1481 | 1901 | 9.9 | 0.78 | 23.0 |
| Inventive Steel 8 | Inventive Material 8 | 1499 | 1948 | 9.7 | 0.77 | 25.6 |
| Inventive Steel 9 | Inventive Material 9 | 1430 | 1903 | 8.9 | 0.75 | 24.2 |
| Inventive Steel 10 | Inventive Material 10 | 1446 | 1876 | 10.0 | 0.77 | 21.4 |
| Inventive Steel 11 | Inventive Material 11 | 1431 | 2029 | 9.3 | 0.71 | 34.8 |
| Inventive Steel 12 | Inventive Material 12 | 1459 | 1964 | 9.5 | 0.74 | — |
| Inventive Steel 13 | Inventive Material 13 | 1409 | 1931 | 9.0 | 0.73 | — |
| Inventive Steel 13 | Inventive Material 14 | 1267 | 2159 | 8.8 | 0.59 | 17 |
| Inventive Steel 14 | Inventive Material 15 | 1519 | 1989 | 9.0 | 0.76 | 21.4 |
| Comparative Steel 1 | Comparative Material 1 | 1568 | 1984 | 7.1 | 0.79 | 17.5 |
| Comparative Steel 1 | Comparative Material 2 | 1504 | 1815 | 7.9 | 0.83 | 22.5 |
| Comparative Steel 2 | Comparative Material 3 | 1511 | 2202 | 7.3 | 0.69 | 17.0 |
| Comparative Steel 3 | Comparative Material 4 | 1488 | 1941 | 9.4 | 0.77 | 31.8 |
| Comparative Steel 4 | Comparative Material 5 | 1525 | 1921 | 8.5 | 0.79 | 21.8 |
| Comparative Steel 5 | Comparative Material 6 | 1524 | 1900 | 8.7 | 0.80 | 27.7 |
| Comparative Steel 6 | Comparative Material 7 | 1590 | 2134 | 8.3 | 0.75 | 28.8 |
| Comparative Steel 7 | Comparative Material 8 | 1707 | 2347 | 2.4 | 0.73 | 12.6 |

TABLE 6

| Steel Type | Sample No. | Corrosion Resistance [Rust (hr)] | Average grain size (μm) | Retained Austenite Fraction (%) | Surface Decarburization (μm) |
|---|---|---|---|---|---|
| Inventive Steel 1 | Inventive Material 1 | 5 | 19.9 | 2.3 | 38-188 |
| Inventive Steel 2 | Inventive Material 2 | 7 | 20.2 | 3.1 | 25-125 |
| Inventive Steel 3 | Inventive Material 3 | 3 | 18.3 | 2.2 | 113-200 |
| Inventive Steel 4 | Inventive Material 4 | 4 | 28.1 | 2.3 | 0-153 |
| Inventive Steel 5 | Inventive Material 5 | 5 | 18.1 | 2.9 | 70-205 |
| Inventive Steel 6 | Inventive Material 6 | 6 | 18.8 | 3.9 | 75-198 |
| Inventive Steel 7 | Inventive Material 7 | — | 14.9 | 3.5 | 98-245 |
| Inventive Steel 8 | Inventive Material 8 | 10 | 12.5 | 2.9 | 62-220 |
| Inventive Steel 9 | Inventive Material 9 | 8 | 32.2 | 2.8 | 102-216 |
| Inventive Steel 10 | Inventive Material 10 | 9 | 25.3 | 3.5 | 100-205 |
| Inventive Steel 11 | Inventive Material 11 | 6 | 25.5 | 3.4 | 0-100 |

TABLE 6-continued

| Steel Type | Sample No. | Corrosion Resistance [Rust (hr)] | Average grain size (μm) | Retained Austenite Fraction (%) | Surface Decarburization (μm) |
|---|---|---|---|---|---|
| Inventive Steel 12 | Inventive Material 12 | 6 | 18.8 | 3.6 | — |
| Inventive Steel 13 | Inventive Material 13 | 5 | 20.2 | 3.7 | — |
| Inventive Steel 13 | Inventive Material 14 | 5 | 20.3 | 3.8 | — |
| Inventive Steel 14 | Inventive Material 15 | 8 | 22.7 | 4.2 | 91-201 |
| Comparative Steel 1 | Comparative Material 1 | 2.5 | 19.2 | 2.5 | — |
| Comparative Steel 1 | Comparative Material 2 | 3 | 19.5 | 2.6 | — |
| Comparative Steel 2 | Comparative Material 3 | — | 16.1 | 6.5 | 84-206 |
| Comparative Steel 3 | Comparative Material 4 | 4 | 17.1 | 6.2 | — |
| Comparative Steel 4 | Comparative Material 5 | 5 | — | 2.2 | — |
| Comparative Steel 5 | Comparative Material 6 | 2 | — | — | 63-188 |
| Comparative Steel 6 | Comparative Material 7 | 1.5 | — | — | 125-200 |
| Comparative Steel 7 | Comparative Material 8 | 1.5 | — | — | 38-220 |

As listed in Tables 1 to 6, in inventive materials (1-15) manufactured using inventive steels (1-14) satisfying relational formulae (1)-(3), quenching cracks were not created, or normal fracture (in the tensile test) which does not include abnormal breakage occurred even after a short maintaining time after quenching. In comparative materials (1-8) manufactured using comparative steels (1-7) which did not satisfy at least one of relational formulae (1)-(3), quenching cracks occurred, or normal fracture occurred only after the maintaining for a long time after the quenching heat treatment. Abnormal fracturing may refer to pre-failure or pre-fracture which has an extremely low total elongation rate on a stress-deformation rate curve in a tensile test.

Also, inventive materials (1-15) exhibited yield strength of 1400-1600 Mpa, tensile strength of 1900-2100 MPa, a yield ratio of 0.7 or higher, relatively high impact absorption energy and a long rust time.

Also, as compared to comparative materials (1-8), in inventive materials (1-15), a decarburization layer was formed with a relatively thin depth.

As shown in Table 1, inventive materials (4, 6, and 15) exhibited normal fracture, whereas comparative material (3) exhibited pre-fracture. Thus, in comparative material (3), fracture occurred before a maximum tensile stress value was exhibited, and an elongation rate value was extremely low.

Also, as shown in FIGS. 2 and 3, a thickened layer in which a content of copper and nickel was relatively higher than that of an internal region of the steel sheet was present on a surface layer of the hot-rolled steel sheets of inventive materials (4) and (12), and the thickening of nickel element was relatively high.

As shown in FIGS. 4(*a*) and 4(*b*), the drawn pipe [FIG. 4(*a*)] before the quenching-tempering heat treatment included ferrite and pearlite phases, whereas the drawn pipe [FIG. 4(*b*)] after the quenching-tempering heat treatment had a typical tempered martensite phase.

The invention claimed is:

1. A member, comprising, by weight %:

0.35-0.55% of C, 0.7-1.5% of Mn, 0.3% or less (excluding 0%) of Si, 0.03% or less (including 0%) of P,
0.004% or less (including 0%) of S,
0.04% or less (excluding 0%) of Al,
0.3% or less (excluding 0%) of Cr,
0.3% or less (excluding 0%) of Mo,
0.1-1.0% of Ni,
0.1-1.0% of Cu,
0.006% or less (excluding 0%) of N, and
a balance of Fe and other impurities,
the alloy elements satisfying relational formulae 1-4 as below,
the member having a microstructure consists of, by volume %, one or two of 90% or more of martensite and tempered martensite, and 10% or less of retained austenite, and
the member has a tensile strength of 1876 MPa or higher, $(Mn/Si) \geq 3$ (a weight ratio) [Relational Formula 1]

$(Ni+Cu)/(C+Mn) \geq 0.2$ (a weight ratio) [Relational Formula 2]

$(Ni/Si) \geq 1$ (a weight ratio) [Relational Formula 3]

$Cu+Ni \geq 0.976\%$ (a weight %). [Relational Formula 4]

2. The member of claim 1, further comprising, by weight %, at least one selected from the group consisting of:

0.04% or less (excluding 0%) of Ti, 0.005% or less (excluding 0%) of B, and 0.03% or less (excluding 0%) of Sb.

3. The member of claim 1, wherein the member has yield strength of 1400 MPa or higher.

4. The member of claim 1, wherein the alloy elements satisfy: $(Mn/Si) \geq 9.8$ (a weight ratio).

5. The member of claim 1, wherein the alloy elements satisfy: $(Ni+Cu)/(C+Mn) \geq 0.56$ (a weight ratio).

6. The member of claim 1, wherein the alloy elements satisfy: $(Ni/Si) \geq 1.65$ (a weight ratio).

7. The member of claim 1, comprising, by weight %: 0.423-0.55% of C.

8. The member of claim 1, comprising, by weight %: 0.7-0.909% of Mn.

9. The member of claim 8, comprising, by weight %: 0.423-0.55% of C.

* * * * *